US008851400B2

(12) United States Patent
Lo

(10) Patent No.: US 8,851,400 B2
(45) Date of Patent: Oct. 7, 2014

(54) SPRINKLER HEAD FOR AN EMBEDDED SPRINKLER

(76) Inventor: Shun-Nan Lo, Taichung (TW)

( * ) Notice: Subject to any disclaimer, the term of this patent is extended or adjusted under 35 U.S.C. 154(b) by 641 days.

(21) Appl. No.: 12/801,091

(22) Filed: May 21, 2010

(65) Prior Publication Data

US 2011/0284659 A1 Nov. 24, 2011

(51) Int. Cl.

| | |
|---|---|
| ***B05B 3/06*** | (2006.01) |
| ***B05B 3/00*** | (2006.01) |
| ***B05B 3/08*** | (2006.01) |
| ***B05B 15/10*** | (2006.01) |
| ***B05B 3/04*** | (2006.01) |

(52) U.S. Cl.

CPC ..... *B05B 3/0431* (2013.01); *B05B 15/10* (2013.01)

USPC ..... 239/263.3; 239/232; 239/255; 239/237; 239/242

(58) Field of Classification Search

USPC ..... 239/200, 201, 203, 204, 205, 206, 239/225.1, 231, 232, 255, 237, 239, 240, 239/242, 263.3, 263, 264, 265, 210

See application file for complete search history.

(56) References Cited

U.S. PATENT DOCUMENTS

| | | | | | |
|---|---|---|---|---|---|
| 4,867,378 | A * | 9/1989 | Kah, Jr. | ..... | 239/206 |
| 4,901,924 | A * | 2/1990 | Kah, Jr. | ..... | 239/242 |
| 5,086,977 | A * | 2/1992 | Kah, Jr. | ..... | 239/205 |
| 6,042,021 | A * | 3/2000 | Clark | ..... | 239/205 |
| 6,732,952 | B2 * | 5/2004 | Kah, Jr. | ..... | 239/225.1 |
| 6,945,471 | B2 * | 9/2005 | McKenzie et al. | ..... | 239/237 |
| 2003/0155433 | A1 * | 8/2003 | Gregory | ..... | 239/203 |

* cited by examiner

*Primary Examiner* — Justin Jonaitis

(74) *Attorney, Agent, or Firm* — Raymond Y. Chan; David and Raymond Patent Firm

(57) ABSTRACT

A sprinkler head for an embedded sprinkler includes a base having a adjust device arranged to an upper portion thereof and an inlet pipe formed to a lower portion thereof. The inlet pipe has a lateral outlet and a receiving chamber. A nozzle is received to the receiving chamber. A gap is formed between the nozzle and the receiving chamber so as the nozzle can be easily removed. A lower toothed ring indirectly rotated by the adjust device is arranged to a bottom of the inlet pipe. Angle between a flexible adjusting sheet extending from the lower toothed ring and a fixed adjusting sheet extending from a bottom of the base can be changed. A sleeve is arranged to the inlet pipe to receive an axial tube of a sprinkler so as to oscillate clockwise and counterclockwise with a driving shaft of the sprinkler.

6 Claims, 12 Drawing Sheets

SPRINKLER HEAD FOR AN EMBEDDED SPRINKLER

FIELD OF THE INVENTION

The present invention relates to embedded sprinkler, and particular to a sprinkler head easily to be removed and replaced. The initial angle of the sprinkler can be adjusted. A slippage function will protect the assembly from damage under adjustment.

DESCRIPTION OF THE PRIOR ART

The US published U.S. Pat. No. 4,901,924 referring to a sprinkler device with angular control discloses a sprinkler head having an adjusting shaft for swing angle on an upper end thereof. An upper outer gear arranged to the adjusting shaft is engaged with a gear of an angular indicating disk. The angular indicating disk has scale around a surface thereof. An elastic cross sheet is arranged to a bottom end of the adjusting shaft. The cross sheet is engaged with a cross recess formed to an upper end of a linking shaft. A lower outer gear is arranged to a bottom end of the linking shaft. The lower outer gear is engaged with a gear disk. The gear disk is arranged to an upper end of a sleeve. The sleeve is slid around a center pipe. A bottom of the sleeve is enlarged as a wide disk, and an elastic spacing sheet extending from the wide disk serves to confine the oscillation of the sprinkler.

While the adjusting shaft is forced rotated after the gear disk reaching a stop, the elastic cross sheet engaged with the cross recess will slip and engage again so as to prevent damage.

However, while the adjusting shaft is slipped, the angular indicating disk will still be rotated so that the angular indication and the actual nozzle position are misaligned.

Moreover, the US published U.S. Pat. No. 7,226,003 referring to rotary drive sprinkler with flow control and shut off valve in nozzle housing discloses a nozzle arranged to an outlet of a water path of a sprinkler. A recess is formed to a bottom edge of the outlet, and a protruded ear is formed to a front center bottom of the nozzle. The protruded ear is opposite to the recess and a gap is formed to a lateral side of the protruded ear between the recess. The gap serves to receive an auxiliary to price the nozzle out of the outlet. However, the protruded ear is formed to the center bottom of the nozzle so that the removal of the nozzle will be impeded by an inclination obstacle.

Referring to US published U.S. Pat. No. 6,802,458 and U.S. Pat. No. 6,732,950, the inventions have function of modifying the initial position of the nozzle.

To achieve the object, the inventions provide a plurality of vertical columns around an inner wall of an outer tube, and gear is formed to a bottom of an elevating sprinkler head. The gear is engaged with the plurality of vertical columns. Therefore, the sprinkler head must to be pulled out of the outer tube so as to modify the initial position of the nozzle and then tightening an upper cover upon the outer tube to confine the sprinkler head within the outer tube.

The above process is minute and complicated for any tiny modification of oscillation.

Moreover, the nozzles of the above inventions are fixed to the receiving chambers by bolts, and the nozzles are total fit to the chambers. The removal of the nozzle will be very difficult.

Therefore, through many trials and experiments, the inventor of the present invention successfully provides a sprinkler head for an embedded sprinkler.

SUMMARY OF THE PRESENT INVENTION

The primary object of the present invention is to provide a sprinkler head for an embedded sprinkler. An initial angle of a nozzle of the sprinkler head can be adjusted. The adjust device of the sprinkler has a slippage function.

To achieve above object, the present invention provides a 1. A sprinkler head for an embedded sprinkler comprising: a base having an upper axial column and an axial hole formed beside the upper axial column; an upper toothed ring being slid to the upper axial column; an inlet pipe formed to a bottom end of the axial column; a lower toothed ring being arranged to the inlet pipe; a column of gear slid into the axial hole; an upper portion of the column of gear being engaged with the upper toothed ring; a lower portion of the column of gear being engaged with the lower toothed ring; a fixed adjusting sheet arranged to a bottom outside of the base; a flexible adjusting sheet extending from a lower end of the toothed ring; wherein the lower toothed ring will be indirectly driven by the upper toothed ring; an oscillation angle of the base will be set by changing an included angle of the fixed adjusting sheet and the flexible adjusting sheet.

Another object of the present invention is to provide a sprinkler head for an embedded sprinkler with a nozzle easily to be removed and replaced.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
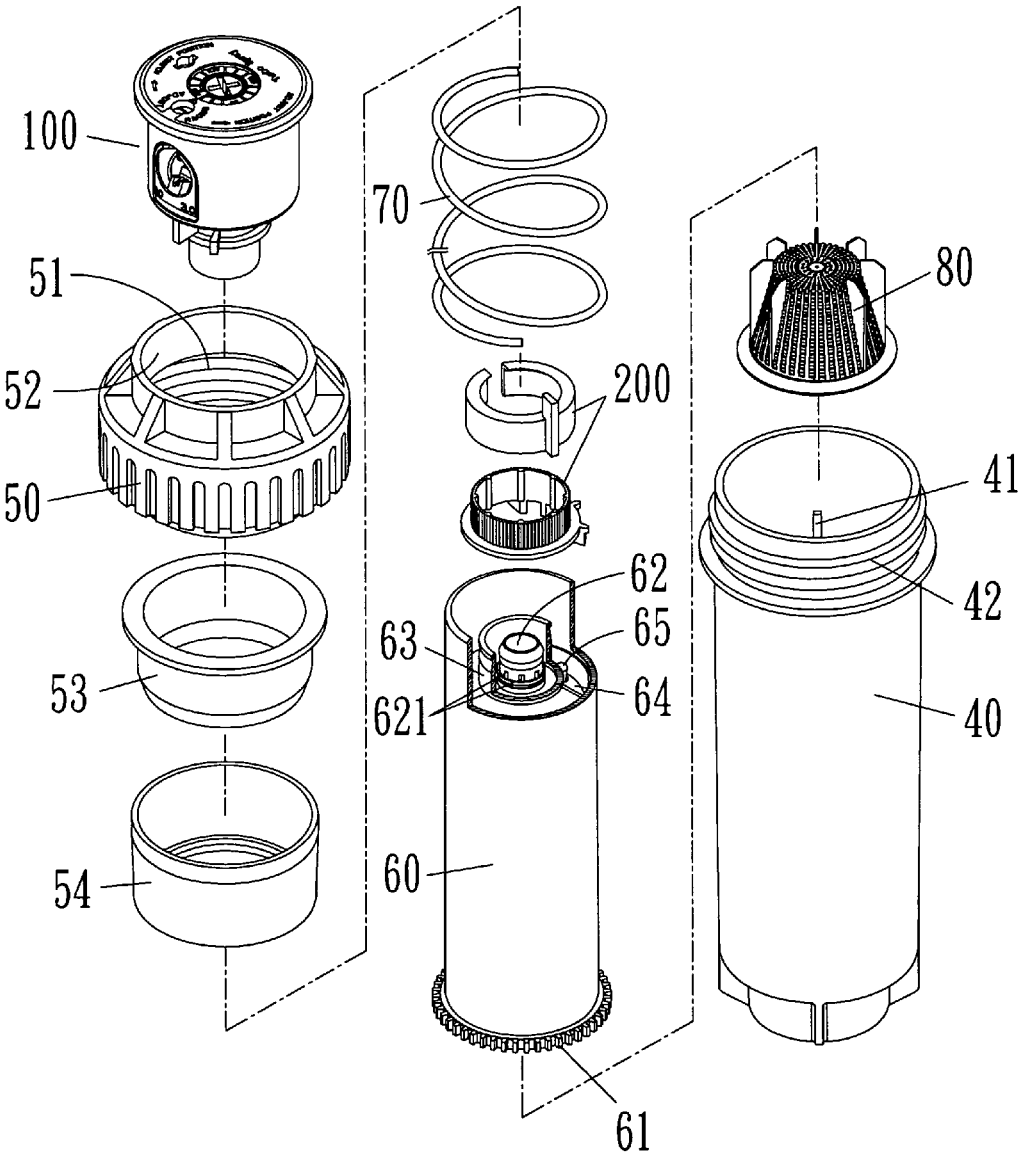
FIG. 1 is an exploded view of a preferable embodiment of the present invention.
Figure 2:
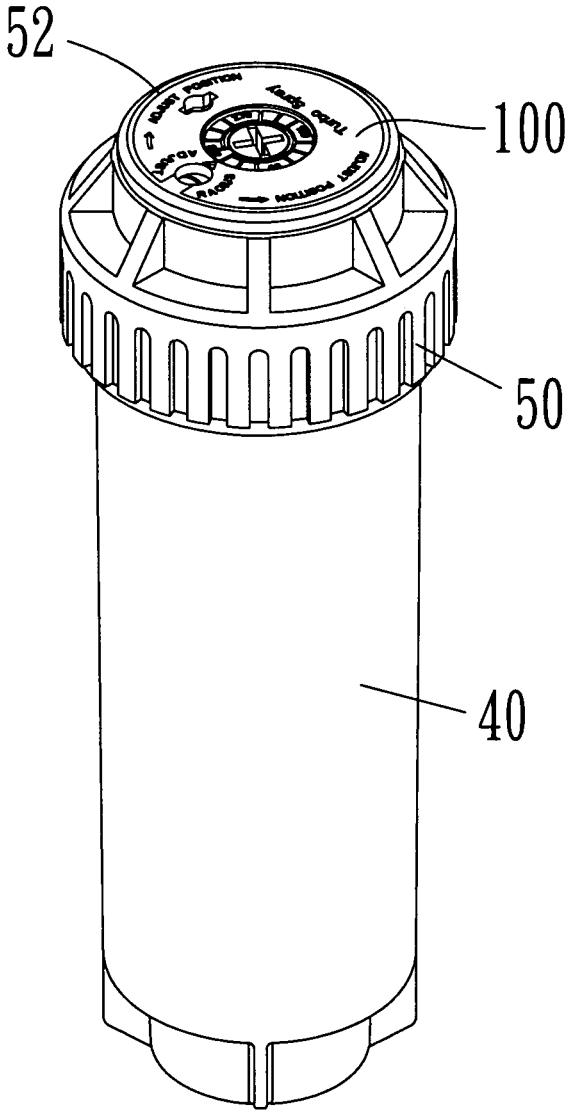
FIG. 2 is an assembling view of the preferable embodiment of the present invention.
Figure 3:
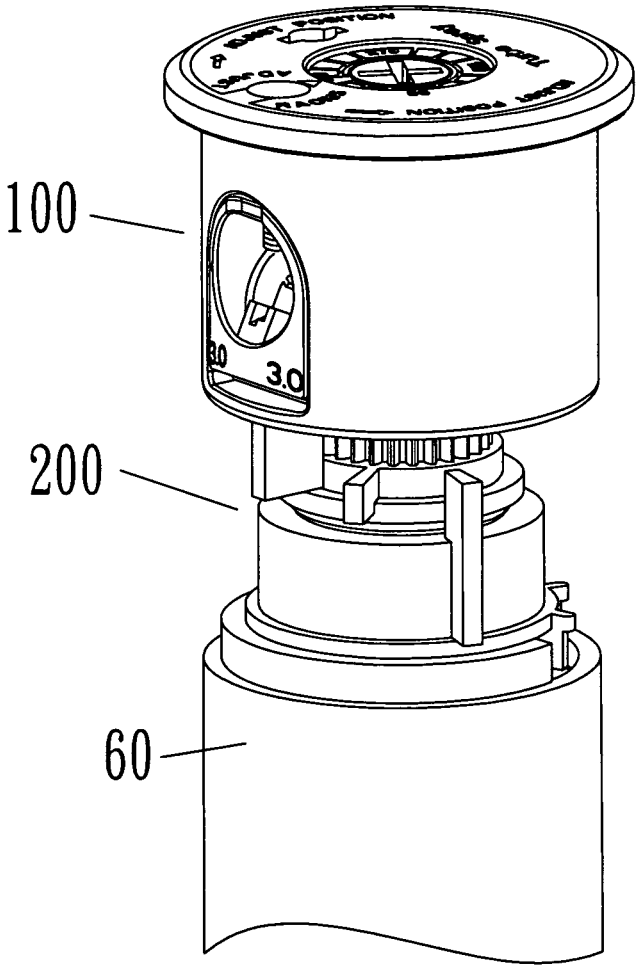
FIG. 3 is a schematic view showing a sprinkler head of the present invention.

Referring to FIG. 1, an embedded rotary sprinkler of the present invention has the following components.

An outer tube 40 has a plurality of teeth 41 formed longitudinally on an inner wall thereof. A bottom of the outer tube 40 can be connected to a water source. An upper end of the outer tube 40 has an outer thread 42 for being screwed by an upper cover 50. The cover 50 having an inner thread 51 has a longitudinal through hole 52 for being slid by an inner tube 60. A wide water seal 53 and a spacing ring 54 are arranged inside the upper cover 50. The water seal 53 can be slid around the inner tube 60, and the spacing ring 54 is slid upon a compress spring 70 slid around the inner tube 60.

A bottom end of the elevating inner tube 60 has a tooth ring 61 engaging the plurality of the teeth 41 while the inner tube 60 is slid into the outer tube 40. The inner tube 60 can vertically elevate along the outer tube 40 by the guide of the teeth 41. An upper surface of the teeth ring 61 can hold a bottom of the compress spring 70. A water path (not shown) guiding a clockwise or counterclockwise water flow is arranged inside the inner tube 60. A driving gear device (not shown) driven by water flow is also arranged inside the inner tube 60. A driving shaft 62 is linked to an upper end of the driving gear device so as to be synchronously rotated with the driving gear device. A plurality of separate teeth 621 with predetermined gap is formed to an upper end of the driving shaft 62, and the upper end of driving shaft 62 is received to an axial tube 63. A bottom of the axial tube 63 has a fan-shaped chamber 64 having an upward open. A rod 65 is arranged to the fan-shaped chamber 64. Most of components inside the inner tube will not be described and claimed in the prevent invention.

The sprinkler head mainly includes a sprinkler head 100 and inlet switch 200 arranged to an upper end of the inner tube 60. The sprinkler head 100 will be rotated with the driving shaft 62.

While water is supplied from the bottom of the outer tube 40, the inner tube 60 will be pushed up. The driving gear device will be rotated by the water flow so that the driving shaft 62 and the linked sprinkler head will be rotated back and forth within a predetermined angle. A nozzle 14 will sprinkle in the same time.

Referring to FIGS. 1 to 12, a sprinkler head for an embedded sprinkler according to the present invention includes the sprinkler head 100 and the inlet switch 200.

Figure 8:
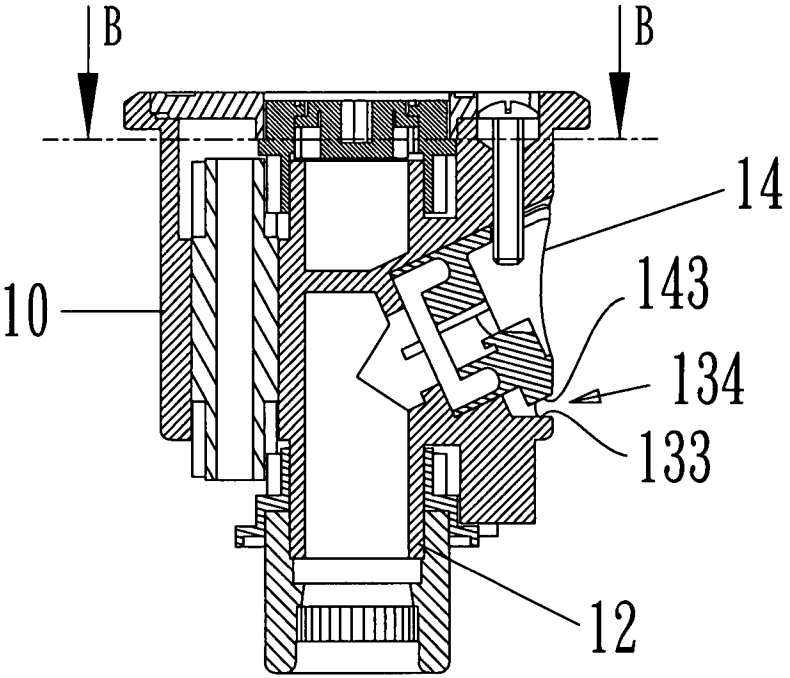
FIG. 8 is a cross-section view through an A-A line of the FIG. 7.
Figure 7:
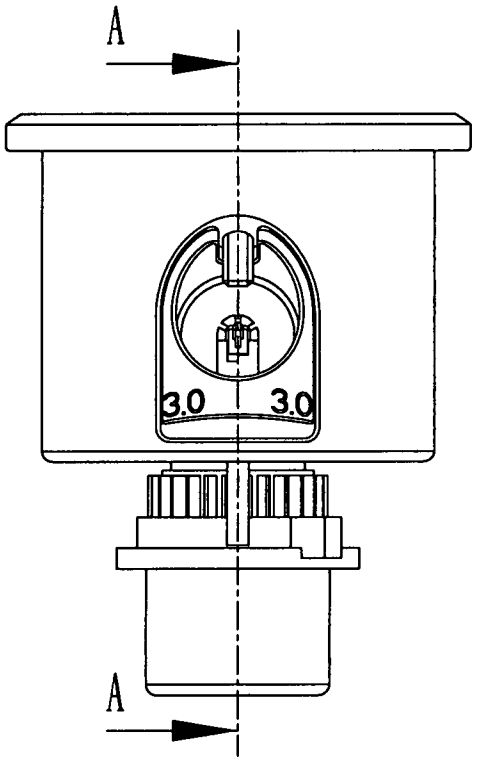
FIG. 7 is a front view of the sprinkler shown in FIG. 4.

The sprinkler head 100 includes a base 10. An axial column 11 is formed to a center of the base 10. An adjusting device 300 is arranged to an upper portion of the axial column 11. A lower portion of the axial column 11 has a water inlet pipe 12. A lateral outlet 121 to the outside of the base 10 is formed laterally to an upper end of the inlet pipe 12. An outer end of the lateral outlet 121 extends as a receiving chamber 13 for receiving a nozzle 14. A screw hole 131 is formed to a top of the base 10 to the receiving chamber 13. A bolt 132 is screwed to the screw hole 131 with a bottom of the bolt 131 reaching to a retaining hole 142 of the nozzle 14 so as to hold the nozzle 14 in the receiving chamber 13. An extend recess 133 is formed to a lower end of the receiving chamber 13. A gap 134 will be formed between a bottom edge 143 of the nozzle 14 and the extend recess 133 as shown in FIG. 8. Through the gap 134, the nozzle 14 can be easily prized out of the receiving chamber 13. A rotatable lower toothed ring 15 is slid to a bottom of the inlet pipe 12, and a sleeve 16 is slid into the lower toothed ring 15 and being fixed to the bottom of the inlet pipe 12. A flexible adjusting sheet 151 is extended from a lower end of the toothed ring 15.

An axial hole 17 parallel to the axial column 11 is formed beside the axial column 11 inside the base 10. A column of gear 18 is slid into the axial hole 17. An upper portion of the column of gear 18 is engaged with an upper toothed ring 31 of the adjusting device 300, and a lower portion of the column of gear 18 is engaged with the lower toothed ring 15. A fixed adjusting sheet 19 is formed to a predetermined position to the bottom of the base 10. An upper cover 191 is arranged to the top of the base 10.

While the adjusting device 300 is rotated, the upper toothed ring 31 will drive the lower toothed ring 15 to rotate through the transmission by the column of gear 18 so that the angle between the adjusting sheets 19 and 151 will be changed. The oscillation angle of the sprinkler head is thus adjusted.

Moreover, the adjusting device 300 in the embodiment includes the upper toothed ring 31 and a knob 32. The upper toothed ring 31 is engaged with the column or gear 18. A ring sleeve 311 is extended upwards from the toothed ring 31. A round hole 312 is formed to a top of the ring sleeve 311 for receiving the knob 32. An inner wall of the ring sleeve 311 has an inner toothed ring 313. The knob 32 is a round step and can be slid into the round hole 312 from bottom of the upper toothed ring 31. A groove 321 is formed to an upper surface of the knob 32 for being twisted by an auxiliary (not shown). A plurality of elastic protruded teeth 322 are formed separately with predetermined gaps to a lower outside of the knob 32. The plurality of protruded teeth 322 can be engaged with the inner toothed ring 313 so as to drive the upper toothed ring 31 while the knob 32 is rotated. While the upper toothed ring 31 is obstructed, the elastic protruded teeth 322 of the knob 32 being rotated will slip and engage with other teeth 322 while the knob 32 is no longer twisted so as to prevent damage by forced rotation.

Figure 4:
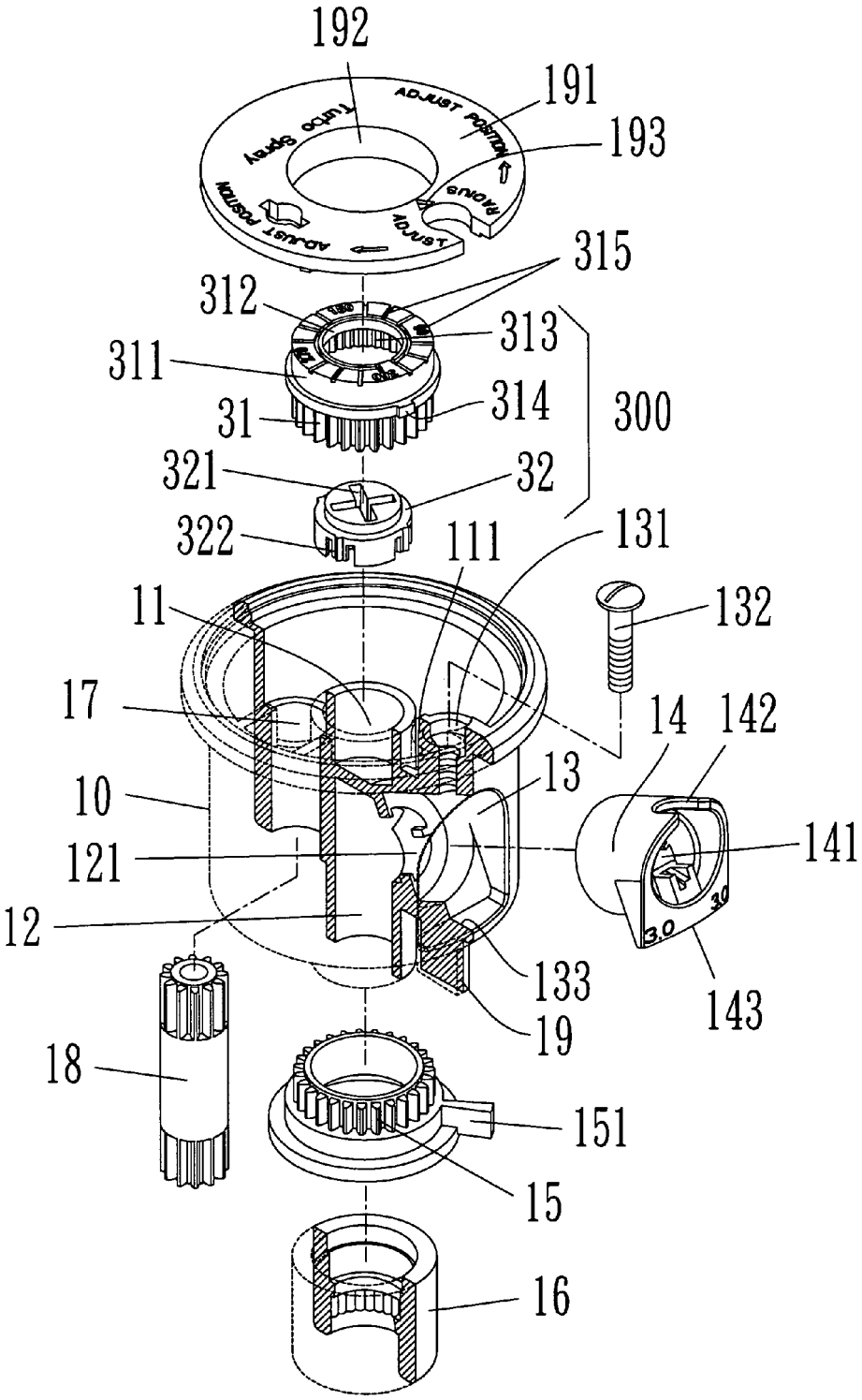
FIG. 4 is a perspective view showing the sprinkler head of the preferable embodiment of the present invention.
Figure 5:
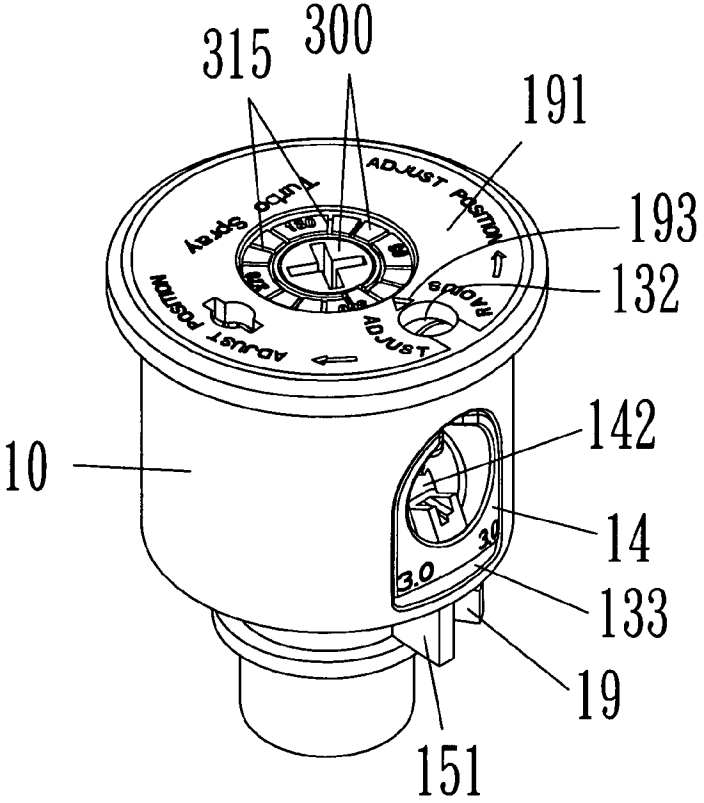
FIG. 5 is a vertical view of the sprinkler shown in FIG. 4.
Figure 9:
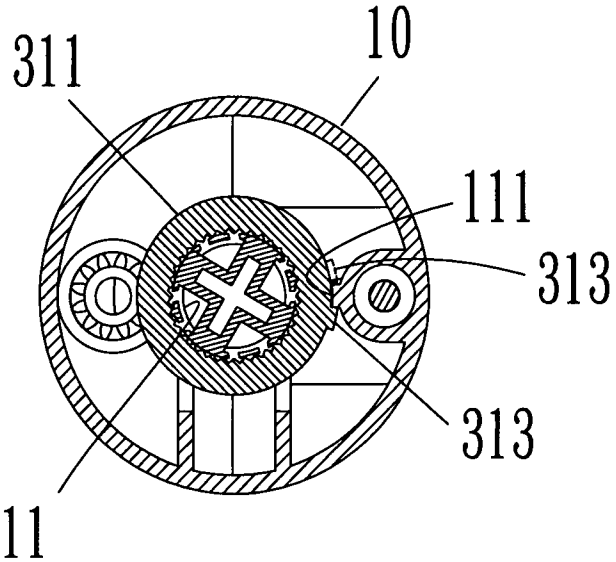
FIG. 9 is a cross-section view through a B-B line of the FIG. 7.
Figure 10:
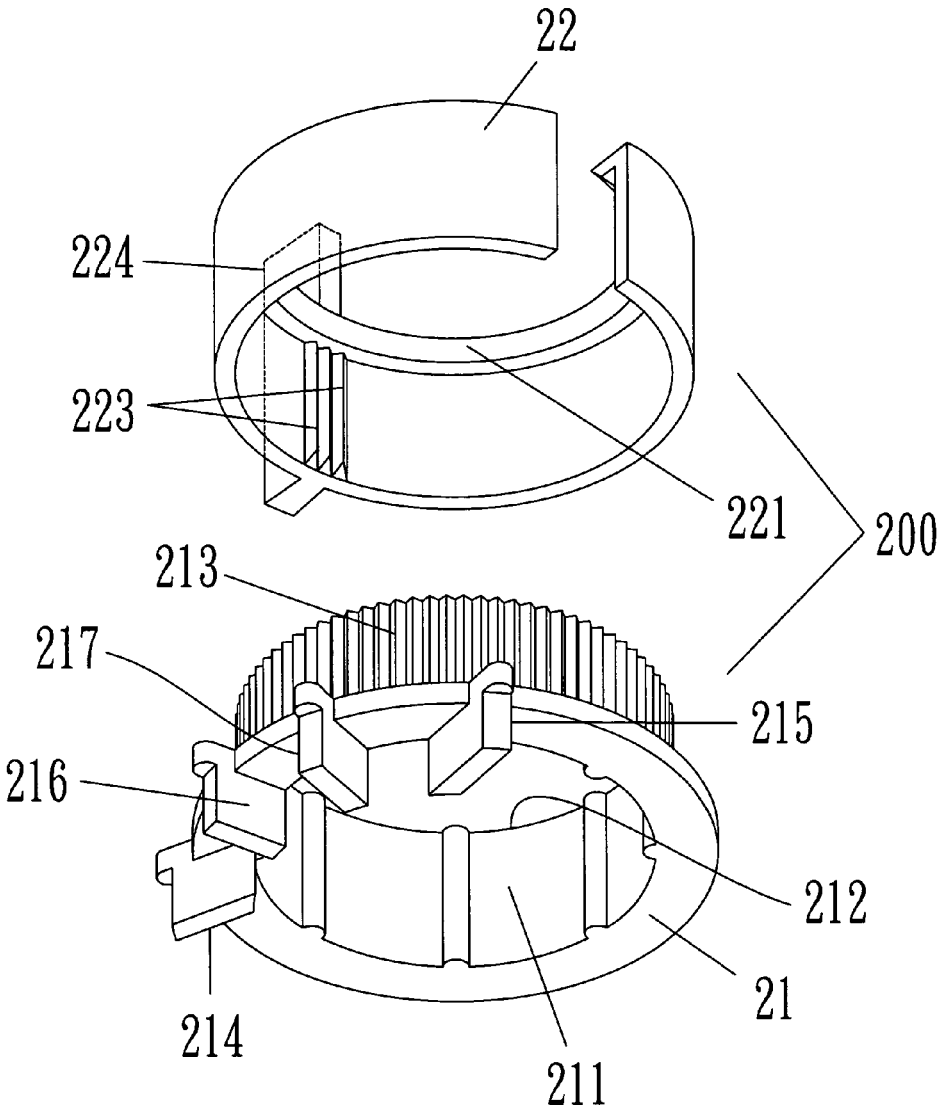
FIG. 10 is an exploded view showing a base of the preferable embodiment of the present invention.
Figure 12:
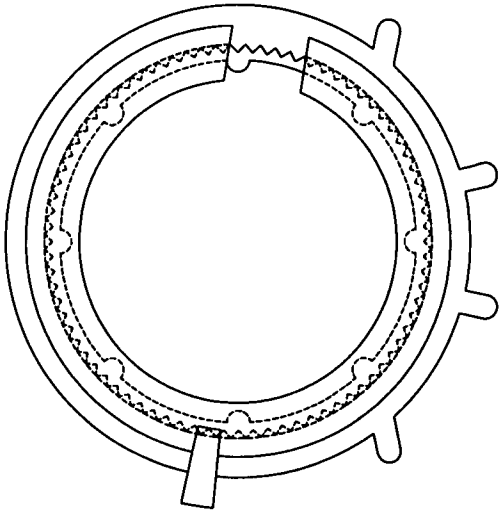
FIG. 12 is a vertical view showing the base of the preferable embodiment of the present invention.
Figure 11:
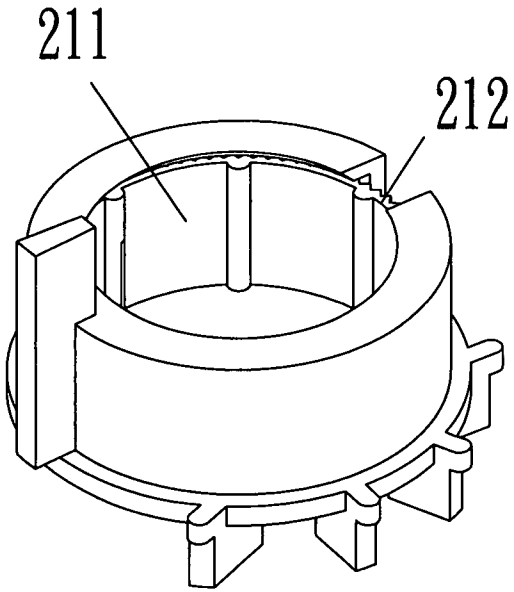
FIG. 11 is an assembly view of the base of the preferable embodiment of the present invention.
Figure 13:
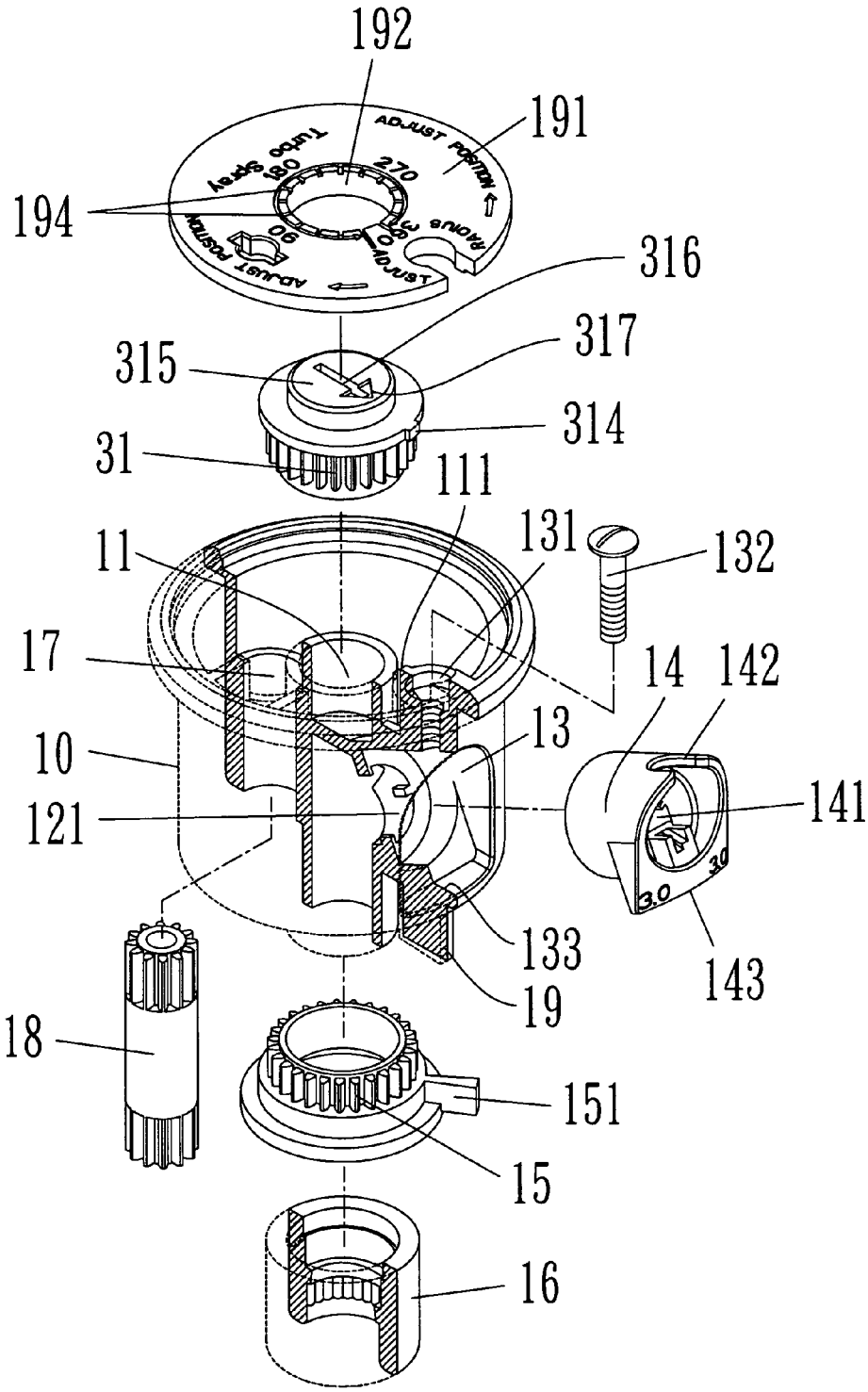
FIG. 13 is an exploded view showing another embodiment of the present invention.
Figure 14:
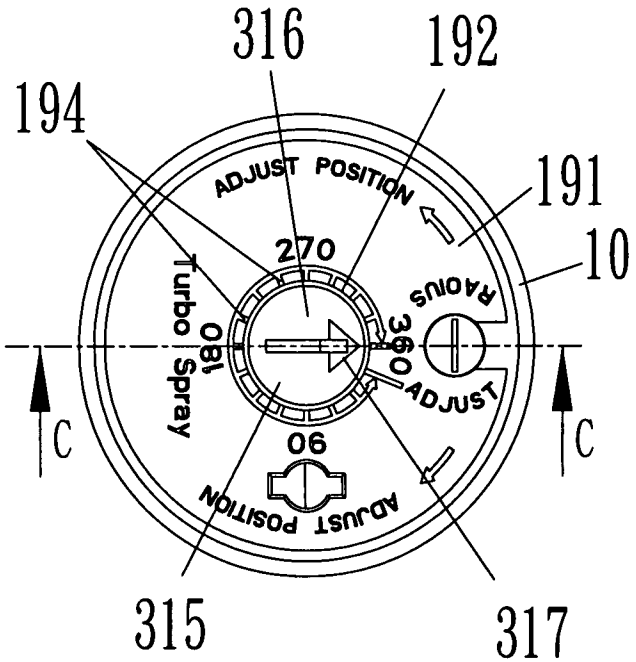
FIG. 14 is a vertical view of the embodiment shown in FIG. 13.
Figure 15:
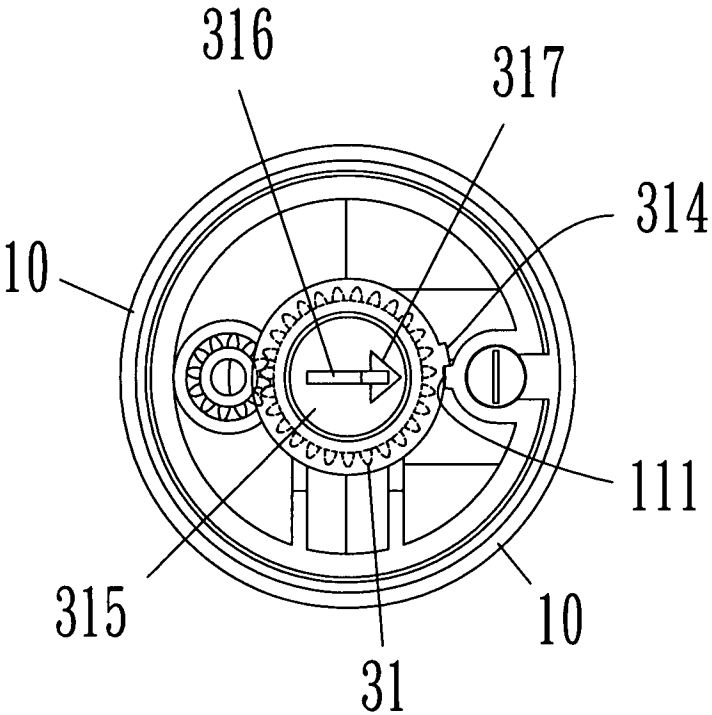
FIG. 15 is a vertical view of the embodiment shown in FIG. 15 without an upper cover.
Figure 16:
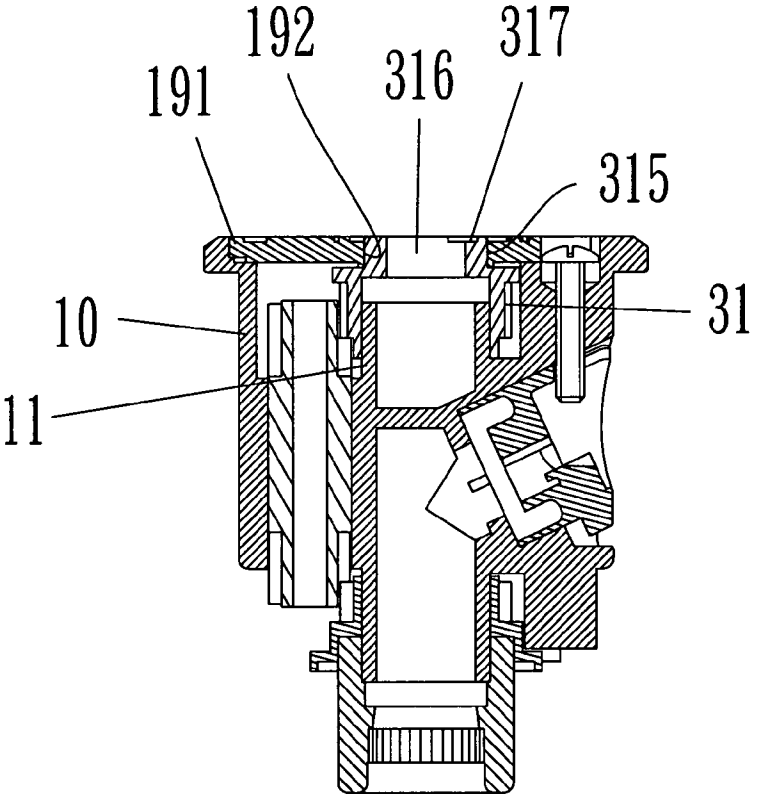
FIG. 16 is a cross-section view through a C-C line of the FIG. 14.

Referring to FIGS. 4, 5, and 9, a protruded stop 111 is formed beside the axial column 10. A protruded block 314 is formed to the outside of the ring sleeve 311. Rotation scale 315 and angle index are formed on the upper surface of the ring sleeve 31. The cap 191 having a round hole 192 is fixed to the top of the base 10 with the ring sleeve 311 being received to the round hole 192 so that the ring sleeve 311 is fixed to the axial column 11 but still free to be rotated. Moreover, an arrow mark 193 is formed to an upper surface of the cap 191. The arrow mark 193 points to the scale 315 of the ring sleeve 311 so as to indicate the oscillation angle of the nozzle 14. User will easily learn and set the oscillation angle of the nozzle 14 through the arrow mark 193 and the scale 315.

While the ring sleeve 311 is rotating, the protruded block 314 will be regarded as a start and an end of the rotation by the impeding of the two edges of protruded stop 111.

The nozzle 14 has an outlet 141 formed axially to the nozzle 14. The retaining hole 142 is formed to the outlet 141. The edge 143 received to the extend recess 133 is extended from the outlet 141.

Figure 6:
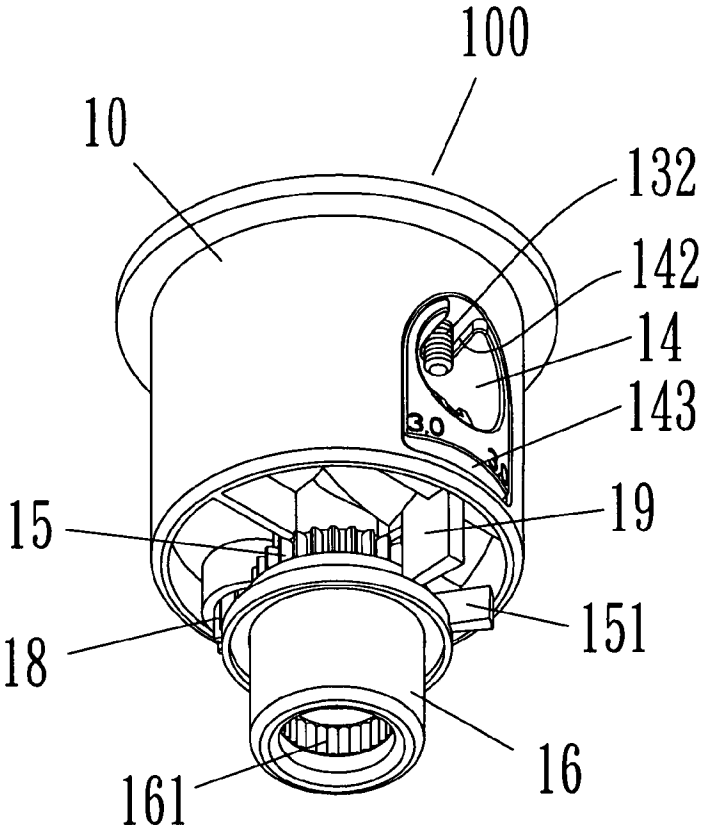
FIG. 6 is an upward view of the sprinkler shown in FIG. 4.

Furthermore, the sleeve 16 connected to the inlet pipe 12 has an inner toothed ring 161 inside of the sleeve 16 (as shown in FIG. 6) for engaging with the teeth 621 of the driving shaft 62. The driving shaft 62 will be alternately rotated clockwise and counterclockwise by the driving of the water flow so that the sleeve 16 and the base 10 will also rotate clockwise and counterclockwise alternately.

The sprinkler head of the present invention also includes the inlet switch 200 slid to the axial tube 63 of the sprinkler.

A fan-shaped chamber 64 is formed to a lateral side below the axial tube 63. The inlet switch 200 includes a rotary seat 21 and a ring cover 22.

The rotary seat 21 has an axial ring 212 having a lower axial hole 211 for receiving the axial tube 63. A toothed ring 213 is formed to the outside of the ring 212. An outer left stop 214 and an outer right stop 215 are extending from a lateral bottom of the ring 212. Between the downward extending outer left and right stop 214 and 215 are an inner left stop 216 and an inner right stop 217. The outer left and right stop 214 and 215 are received into the fan-shaped chamber 64, and a top of the rod 65 is received between the inner left and right stop 216 and 217.

The ring cover 22 has an upper axial hole 221 formed axially to the ring cover 22 for receiving the axial tube 63. A receiving chamber 222 having a downward open is formed inside the ring cover 22 for receiving the ring 212 of the rotary seat 21. A plurality of elastic sheets 223 formed separately with predetermined gaps extends from an inner wall of the receiving chamber 222. The ends of the plurality of elastic sheet 223 are buckled to the toothed ring 213. A vertical plate 224 extends upward from a lateral side of the ring cover 22.

The vertical plate 224 is arranged between the fixed adjusting sheet 19 of the base 10 and the flexible adjusting sheet 151 of the lower toothed ring 15. While the base 10 is driven by water flow to rotate clockwise or counterclockwise, the rotated adjusting sheets 19 and 151 will hit the vertical plate 224 so as to rotate the inlet switch 200. The rod 65 between the inner stops of the inlet switch 200 will be swung so as to change the direction of water flow. Therefore, the oscillation of the sprinkler is formed.

Therefore, the base 10 will be rotated in a direction with one of the adjusting sheets 19 and 151 hitting the vertical plate 224 and then the inlet switch 200 will be rotated with the base 10 until one of the outer left and right stops 214 and 215 hits the wall of the fan-shaped chamber 64. Through the elastic sheets 223 of the ring cover 22, the ring cover can be rotated relative to the rotary base 21 so as to change an initial direction of the nozzle 14.

Referring to FIGS. 13 to 16, another preferable embodiment of the present invention is shown. The difference of the embodiment is a rotatable upper toothed ring 31 arranged to the axial column 11 of the base 10. The upper toothed ring 31 is engaged with an upper portion of a column of gear 18 arranged an axial hole 17 of the base 10. The lower portion of the column of gear 18 is engaged with a lower toothed ring 15 arranged to the inlet pipe 12. A protruded stop 111 is arranged to an outer surface of the axial column 11 of the base 10. A protruded block 314 is formed to an upper outside of the upper toothed ring 31. While the ring sleeve 311 is rotated, the protruded block 314 will be stopped by the two lateral edges of the protruded stop 111. A round step 315 is formed to a top of the upper toothed ring 31. A recess 316 formed diametrically on a top surface of the round step 315. An arrow mark 317 is formed to an end of the recess 316.

Moreover, a cap 191 having a round hole 192 is fixed to the top of the base 10 with the upper toothed ring 31 being received to the round hole 192 so that the upper toothed ring 31 is fixed to the axial column 11 but still free to be rotated. Furthermore, rotation scale 194 and angle index are formed around the round hole 192. The arrow mark 193 points to the scale 194 so as to indicate the oscillation angle of the nozzle 14.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sprinkler head for an embedded sprinkler, comprising:
a base having an upper axial column and an axial hole formed beside the upper axial column;
an upper toothed ring being slid to the upper axial column;
an inlet pipe formed to a bottom end of the axial column;
a lower toothed ring being arranged to the inlet pipe;
a column of gear slid into the axial hole, wherein an upper portion of the column of gear is engaged with the upper toothed ring, wherein a lower portion of the column of gear being engaged with the lower toothed ring;
a fixed adjusting sheet arranged to a bottom outside of the base;
a flexible adjusting sheet extending from a lower end of the toothed ring, wherein the lower toothed ring is indirectly driven by the upper toothed ring, wherein an oscillation angle of the base is set by changing an angle of the fixed adjusting sheet and the flexible adjusting sheet; wherein a round step is formed to a top of the upper toothed ring; an upper cap is arranged to a top of the base; the cap has a round hole for receiving to the round step.

2. The sprinkler head for an embedded sprinkler as claimed in claim 1, wherein a recess is formed diametrically on a top surface of the round step, wherein an arrow mark is formed to an end of the recess, wherein a rotation scale and angle index are formed around the round hole for the arrow mark to indicate the oscillation angle.

3. A sprinkler head for an embedded sprinkler, comprising:
a base having an upper axial column and an axial hole formed beside the upper axial column;
an upper toothed ring being slid to the upper axial column;
an inlet pipe formed to a bottom end of the axial column;
a lower toothed ring being arranged to the inlet pipe;
a column of gear slid into the axial hole, wherein an upper portion of the column of gear is engaged with the upper toothed ring, wherein a lower portion of the column of gear being engaged with the lower toothed ring;
a fixed adjusting sheet arranged to a bottom outside of the base;
a flexible adjusting sheet extending from a lower end of the toothed ring, wherein the lower toothed ring is indirectly driven by the upper toothed ring, wherein an oscillation angle of the base is set by changing an angle of the fixed adjusting sheet and the flexible adjusting sheet; wherein a protruded stop is formed to the axial column; a protruded block is formed to the outside of the upper toothed ring; while the upper toothed ring is rotating, the protruded block will be stopped by the two lateral edges of the protruded stop.

4. A sprinkler head for an embedded sprinkler, comprising:
a base having an upper axial column and an axial hole formed beside the upper axial column;
an upper toothed ring being slid to the upper axial column;
an inlet pipe formed to a bottom end of the axial column;
a lower toothed ring being arranged to the inlet pipe;
a column of gear slid into the axial hole, wherein an upper portion of the column of gear is engaged with the upper toothed ring, wherein a lower portion of the column of gear being engaged with the lower toothed ring;
a fixed adjusting sheet arranged to a bottom outside of the base;
a flexible adjusting sheet extending from a lower end of the toothed ring, wherein the lower toothed ring is indirectly driven by the upper toothed ring, wherein an oscillation angle of the base is set by changing an angle of the fixed adjusting sheet and the flexible adjusting sheet, wherein the inlet pipe is formed to the bottom end of the axial column, wherein a lateral outlet to the outside of the base is formed laterally to an upper end of the inlet pipe; wherein an outer end of the lateral outlet extends as a receiving chamber for receiving a nozzle, wherein an extend recess is formed to a lower end of the receiving chamber; wherein the nozzle has a bottom edge opposite to the extend recess; wherein a gap is formed between the bottom edge and the extend recess; through the gap, the nozzle can be easily removed from the receiving chamber.

5. A sprinkler head for an embedded sprinkler, comprising: an adjusting device for adjusting an oscillation angle of the sprinkler head having an upper toothed ring; a knob being arranged to an upper round hole; an inner toothed ring being formed to an inner wall thereof; a groove being formed to an upper surface of the knob; a plurality of elastic protruded teeth being formed separately with predetermined gaps to a lower outside of the knob; the plurality of protruded teeth being engaged with the inner toothed ring; while the rotation of the upper tooth ring being obstructed, the elastic protruded teeth of the knob slipping so as to prevent damage by forced rotation; and inlet switch slid to a sprinkle; the inlet switch including a rotary seat and a ring cover; the rotary seat having an axial ring with a lower axial hole; a toothed ring being formed to the outside of the ring; the ring cover having an upper axial hole opposite to the lower axial hole; a receiving chamber having a downward open being formed inside the ring cover for receiving the ring of the rotary seat; a plurality of elastic sheets being formed separately with predetermined gaps to an inner wall of the receiving chamber; the ends of the plurality of elastic sheet being buckled to the toothed ring; a vertical plate extending upward from a lateral side of the ring cover; the vertical plate being between a fixed adjusting sheet and a flexible adjusting sheet so as to adjust a initial position of the sprinkler head.

6. The sprinkler head for an embedded sprinkler as claimed in claim 5, wherein the rotary seat has an outer left stop and an outer right stop extending from a lateral bottom of the ring; wherein an inner left stop and an inner right stop are formed between the downward extending outer left and right stops; wherein the outer left and right stops are received into a fan-shaped chamber, wherein a top of a rod is received between the inner left and right stops.

* * * * *